US006457223B1

(12) United States Patent
Breton et al.

(10) Patent No.: US 6,457,223 B1
(45) Date of Patent: Oct. 1, 2002

(54) METHOD OF MANUFACTURING COSMETIC CONTAINER

(75) Inventors: Christian Breton, Saint Pavace; Denis Pandolfi, Les Breviaires; Jean-Luc Perrier, Chaville, all of (FR)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/576,247

(22) Filed: May 24, 2000

(30) Foreign Application Priority Data

Jun. 7, 1999 (GB) ..... 9913114

(51) Int. Cl.[7] ..... B23P 17/00; B65D 85/72

(52) U.S. Cl. ..... 29/417; 72/68; 206/385; 401/78

(58) Field of Search ..... 206/385; 132/317, 132/318, 320; 401/68, 72–78; 29/417, 527.2, 527.3, 527.6; 72/68, 348, 347

(56) References Cited

U.S. PATENT DOCUMENTS

| | | | | |
|---|---|---|---|---|
| 2,866,569 A | | 12/1958 | Morrison | |
| 2,878,771 A | * | 3/1959 | Grau | 29/417 |
| 3,123,904 A | * | 3/1964 | Hopgood | 29/417 |
| 3,124,872 A | * | 3/1964 | Knodel, Jr. | 29/417 |
| 3,356,108 A | * | 12/1967 | Johnston | 29/527.2 |
| 3,586,452 A | * | 6/1971 | Mason | 401/78 |
| 3,756,493 A | | 9/1973 | Holmes | |
| 4,166,474 A | * | 9/1979 | McArdle et al. | 401/68 |
| 4,514,102 A | * | 4/1985 | Ackerman et al. | 401/78 |
| 4,603,989 A | * | 8/1986 | Ackerman et al. | 401/78 |
| 5,468,084 A | | 11/1995 | Boninsegni et al. | |
| 5,553,753 A | | 9/1996 | Abplanalp | |
| 5,605,408 A | * | 2/1997 | Su | 401/78 |
| 5,653,338 A | * | 8/1997 | Tani | 206/385 |
| 5,893,672 A | | 4/1999 | Erickson | |

FOREIGN PATENT DOCUMENTS

| | | |
|---|---|---|
| EP | 0246889 | 11/1987 |
| EP | 0259020 | 3/1988 |
| EP | 0709043 | 5/1996 |
| GB | 1215762 | 12/1970 |
| GB | 1276859 | 6/1972 |
| WO | WO 87/07121 | 12/1987 |

* cited by examiner

*Primary Examiner*—Bryon P. Gehman
(74) *Attorney, Agent, or Firm*—Diller, Ramik & Wight

(57) ABSTRACT

A cosmetic container comprising an extruded metal sleeve and at least one plastics part inserted in the sleeve. The plastics part may take the form of a plastics end and/or an insert to ensure smooth engagement between the parts of the container. The extruded sleeve is manufactured by forming a long extruded tube of the required diameter and then cutting it into lengths to produce a plurality of metal sleeves.

20 Claims, 4 Drawing Sheets

METHOD OF MANUFACTURING COSMETIC CONTAINER

TITLE OF THE INVENTION

BACKGROUND OF THE INVENTION

The present invention relates to part metal containers for cosmetic preparations, such as lipstick and mascara. Such containers are generally tubular and may contain an applicator, in the case of mascara, or a raise/lower mechanism, in the case of lipstick.

At one time, such containers were all metal but more recently, plastic has become the material most commonly used in their manufacture. Plastic components have many advantages. For example, they can be easily and cheaply moulded in complex shapes, they provide a smoother engagement with less noise than metal components and the plastics composition can be modified to provide certain barrier properties. However, consumers prefer the weight and feel of metal components and associate these characteristics with quality and durability. Hence, it is desirable to provide a plastics container having the look and feel of a metal component.

Several methods have been used to provide plastics containers which have the external appearance of a metal container. Such methods include electroplating the external surfaces of the plastics container with a thin metal layer. The disadvantage of this method is that the container has the appearance of a metal container but does not have the weight or feel of a metal component.

Alternatively, a pressed metal shroud may be provided around the external surface of a moulded plastics container. The plastic component is housed inside the metal shroud. This arrangement combines the advantages of producing the container from a plastics material, whilst the external metal shroud provides the appearance of a metal component. The metal shroud also improves the weight and feel of the container. However, the metal forming and stamping process requires a large investment in machinery and tooling. Transfer presses are required, having between 4 and 12 stages. During each stage the final shape of the component is progressively formed, starting from a thin sheet of metal. Once the metal shroud has been formed, a surface finish is then applied to the external surface of the shroud, for example varnish or paint.

SUMMARY OF THE INVENTION

The aim of the present invention is to provide an improved method of manufacture for all or part of a tubular cosmetic container, having the look and feel of a metal component. The method according to the invention requires simpler machinery and tooling than the prior art and therefore lower capital investment than that currently needed to produce pressed metal shrouds.

Accordingly, the invention provides a method of manufacture for tubular cosmetic containers, each container having at least one plastics part and a metal sleeve, comprising the steps of:

i. Extruding a metal tube having the desired cross section, ii cutting the metal tube into lengths to produce a plurality of metal sleeves, and iii. arranging at least one moulded plastics part in each of the metal sleeves.

The method of manufacture according to the invention uses an extrusion process to form the metal part of the container. The extrusion process is a one-step process requiring much simpler and cheaper equipment than the multi-stage presses needed to produce conventional pressed shrouds. A metal blank of suitable size and shape is input into the extruder. The extruder produces a long, extruded tube of the required cross sectional shape, in a single process step. The extrusion technique can be used to produce a wide variety of cross sectional shapes by use of a suitably shaped die. Hence, the extruded metal shroud may have a more complex profile than that which can currently be produced using pressing techniques.

Furthermore, due to the multi-stage forming of pressed metal shrouds, thin metal plate is used as the starting material for the pressing process. Hence, the final pressed component is relatively thin. On the contrary, the extrusion process can be used to produce a tube having a much greater wall thickness. This has the advantage that the extruded tube will be more robust than an equivalent pressed shroud and thereby less prone to damage. Furthermore, use of a thicker metal shroud improves the weight and feel of the component.

Preferably, a metal blank of suitable material is heated to a temperature just below that at which the material begins to soften. The heated metal blank is fed into the extruder and a long, thin, extruded metal tube (of approximately 30 to 50 metres in length) is emitted. As it is pushed out of the extruder, the extruded tube tends to curve and snake. Thus, the extruded tube is preferably stretched as it leaves the extruder, to straighten it. The stretching process is preferably carried out when the material is almost cold. The extruded tube may then be cut into the required lengths to make shrouds for a number of cosmetic containers.

Advantageously, where a surface finish is required, the surface treatment is applied to the extruded tube before it is cut into shorter lengths. Numerous surface finishes can be applied including, brushed, anodised, varnished, lacquered and painted. The surface finish is much simpler and easier to apply to the long tube lengths than to discrete components, which have to be handled individually and loaded into trays for application of the surface finish. Hence, a large number of finished, extruded, metal shrouds can be produced cheaply and with less labour than that currently required to produce conventional finished, pressed components.

The cosmetic container further comprises an end, which is held captive in the extruded metal tube. The end may be made from metal or a plastics material and may have the same external appearance as the extruded tube. Where a metal finish is required, a plastics end may be electroplated. This is a much simpler process than that required to electroplate the whole of a plastics cosmetic container. Only one side of the ends needs to be coated, therefore, the ends can simply be arranged in a tray for electroplating. When electroplating a conventional plastic cosmetic container, the whole external surface of the container needs to be coated. Therefore, the containers are usually suspended to ensure complete coverage of the thin metal layer.

Where the container comprises a body and a lid, both comprising extruded metal sleeves, the container preferably comprises a plastics insert to ensure smooth engagement of the components during assembly and smooth, quiet use of the container by the consumer. The plastics insert may be provided as a separate component in addition to the end. Alternatively, the plastics insert may be adapted to provide both a smooth engagement surface and an end for the extruded metal sleeve.

The plastics component/s may be moulded separately and retained in the extruded metal tube using known techniques, for example adhesives, a snap fit arrangement or an interference fit. Alternatively, the plastics component/s may be moulded directly inside the extruded tube, thereby eliminating the need for an additional assembly step.

Where the tubular container is used to hold pomades, such as lipstick, the plastics part/s may be adapted to retain or form part of a raise/lower mechanism.

Containers for liquid cosmetics, such as mascara, lip gloss etc. conventionally comprise a lid and a body. The body takes the form of a bottle, to hold the liquid cosmetics, and the lid is adapted to hold an applicator. In accordance with the invention, such containers may comprise a lid having an extruded metal sleeve, an end and a plastics insert adapted to provide or retain the applicator. The body may be provided by a conventional bottle. However, advantageously, the body is also encased in an extruded metal sleeve.

Metal has good barrier properties and this makes the container particularly suitable for storing newer cosmetics compounds, which are often volatile. At present, known barrier cosmetic containers are manufactured from PVC and have thick walls, to provide the necessary barrier properties. However, PVC is banned in many countries. A cosmetic container comprising an extruded metal sleeve encasing a bottle having a thick base but thinner side-walls, will have good barrier properties, without the problems associated with PVC or the requirement for thicker walled containers, which are both costly to produce and more bulky.

Using conventional pressing techniques, it is not possible to produce a metal shroud for conventional cosmetic containers for mascara, for example. The height of the shroud is limited because the pressing technique requires metal to be drawn from the base into the sidewall to provide the height for the shroud. Conversely, using an extrusion process, a long tube can be extruded of the required diameter and this tube can then be cut into any desired length to produce a suitable metal sleeve. Thus, the method according to the invention allows the manufacture of cosmetic containers having any diameter to height ratio required.

The extrusion process may also be used to define a longitudinal groove or rib on the internal surface of the metal sleeve. The internal groove or rib may be used to align the various components of the cosmetic container, for example a lid and a body, and is particularly useful where the external surface of the extruded tube has a complex shape or where a design is applied to the external surface of the tube.

Typically, cosmetic containers according to the invention, are manufactured in an in-line process starting with extrusion of the metal tube and finishing thereof and progressing to full automatic assembly of the metal and plastics parts. Obviously, the plastics parts may be moulded independently of the in-line process. However, where the plastics parts are moulded in-situ inside the extruded tube, the moulding process preferably forms part of the in-line process.

Preferably the extruded metal tube is made of aluminium. The plastics material for the insert is chosen to have the required specification in terms of flexibility, roughness and slide coefficient. Preferably, the plastics insert is moulded from polyethylene or polypropylene.

The invention will now be described, by way of example only, with reference to the accompanying drawings, in which:

BRIEF DESCRIPTION OF THE DRAWINGS

Wherever possible, like components shown in the FIGS. have been given the same reference numerals.

DESCRIPTION OF THE PREFERRED EMBODIMENTS

Figure 1:
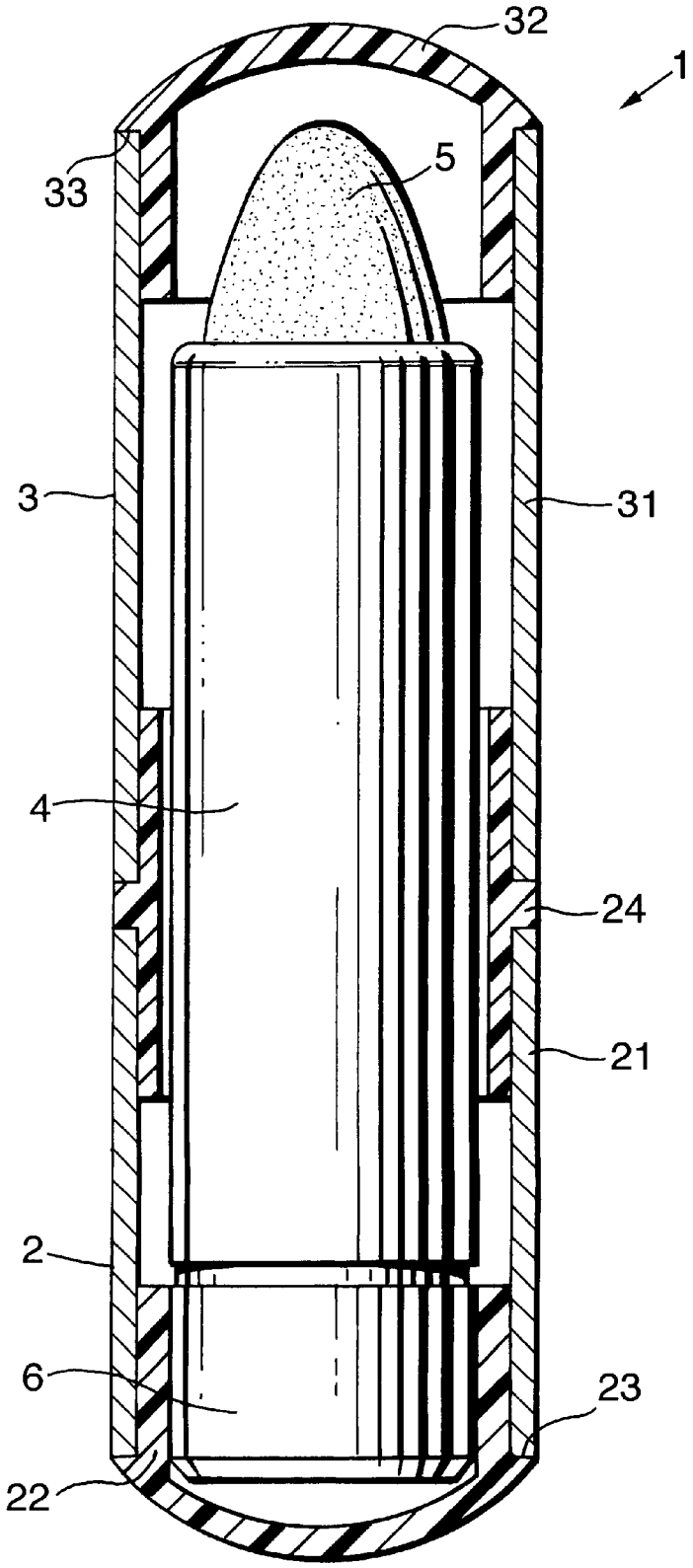
FIG. 1 shows a partial side section view of a lipstick case according to one embodiment of the invention.

Referring to FIG. 1, a lipstick case 1 comprises a base 2 and a cover 3. The base 2 includes a holder 4 for a pomade of lipstick 5. The holder 4 incorporates a raise/lower mechanism 6 to allow the lipstick 5 to be raised and lowered by a user of the lipstick.

The base 2 comprises an extruded aluminium sleeve 21 and a plastics end 22. The end 22 overlaps the sleeve 21 to define a stop 23 against which the aluminium sleeve 21 is pressed during assembly. The end 22 retains a holder 4 and raise/lower mechanism 6 for a lipstick 5. The aluminium sleeve 21 and plastics end 22 may be held together using conventional techniques, such as a slight interference fit, snap engagement or adhesive.

Figure 2:
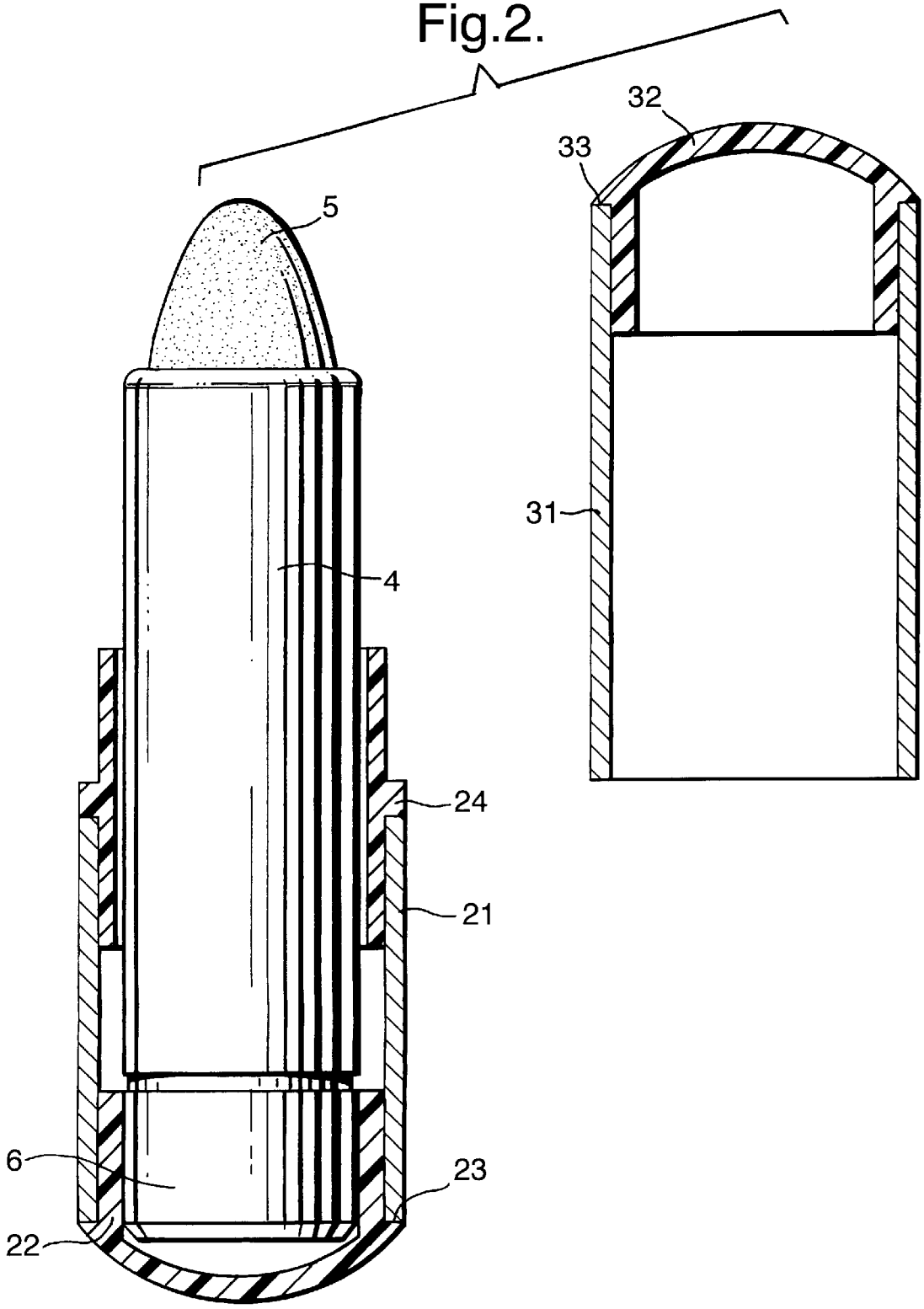
FIG. 2 shows the lipstick case of FIG. 1 with the cover removed from the base.

The cover 3 also comprises an extruded aluminium sleeve 31 and a plastics top 32. The top 32 overlaps the sleeve 31 to define a stop 33 against which the aluminium sleeve 31 is pressed during assembly. Preferably, the plastics top 32 is identical to the plastics end 22 on the base 2 (as shown in FIGS. 1 and 2). This minimises the number of different plastics components which have to be moulded and thereby reduces the cost of the cosmetic container. As described above, the aluminium sleeve 31 and plastics top 32 are held together using conventional joining techniques.

A plastics connector 24 is provided between the free ends of the base 2 and cover 3. The plastics connector 24 is adapted to fit inside the metal sleeves 21 and 31 and is held in place either in the base 2 or the cover 3 by means of conventional joining techniques (as shown in FIG. 2). The remaining end of the connector 24 is adapted to removably engage with the other of the base 2 or cover 3 as appropriate. The connector 24 ensures that there is a smooth, removable engagement between the base 2 and the cover 3 of the lipstick case 1.

In an alternative arrangement, the connector 24 and end cap 22, 32 of the base 2 or the cover 3 may be provided as a single plastics insert. In this arrangement, the plastics insert protrudes beyond the free edge of the base or cover to provide an engagement portion to locate with the other of the base or cover and hold the two parts releasably together. In yet another arrangement, both the base and the cover may be provided with plastic connector inserts having mutual engagement means, such as snap beads, to releasably hold the base 2 and the cover 3 together.

The base 2 and cover 3 are manufactured using the same general method. A heated aluminium blank is inserted into an extruder and a thin, aluminium tube is extruded, having the required cross section. On leaving the extruder, the aluminium tube is stretched to ensure that it lies straight. Where required, a surface treatment is then applied to the tube. Next, the tube is cut into segments of the required lengths to provide the extruded aluminium sleeves 21, 31.

The plastics inserts 22, 32 may be moulded separately and then assembled in the sleeves 21, 31 or alternatively may be moulded in-situ using known insert moulding techniques.

From FIGS. 1 and 2, it can be seen that the metal lipstick case 1 comprises only three main components: The extruded aluminium sleeves 31, 32, the end caps 22, 32 and the plastics connector 24. Preferably, the base 2 is assembled with the plastics end cap 22 and connector 24 fixed inside the extruded metal sleeve 21. The pomade holder 4 and raise/lower mechanism 6 is also assembled inside the base 2. Preferably, the cover 3 is also assembled with the plastics end cap 32 fixed inside the extruded metal sleeve 31. The bases 2 and covers 3 are then provided to the manufacturer of the pomade who inserts the lipstick 5 into the base 2 and assembles the covers on the bases. Alternatively, where required, the lipstick cases may be provided in three component parts, namely the base 2, cover 3 and pomade holder 4/raise lower mechanism 6.

Figure 3:
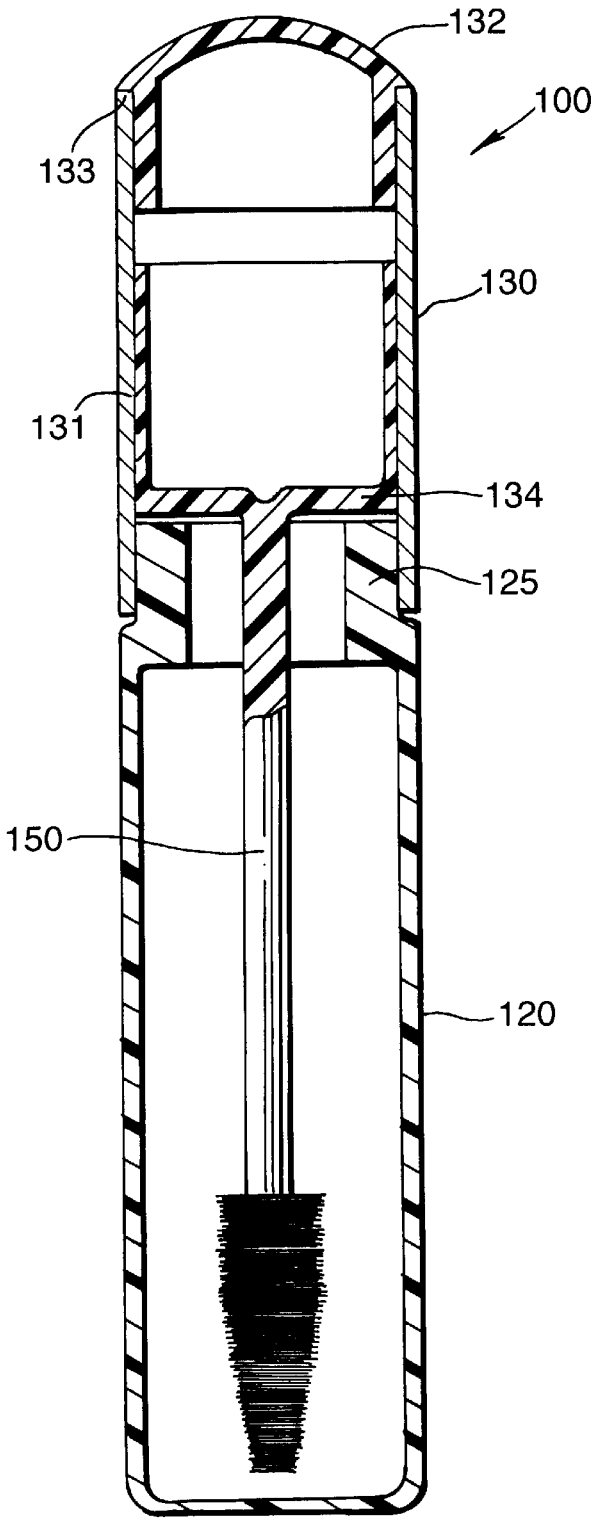
FIG. 3 shows a side section view of a mascara container according to the invention.

Referring to FIG. 3, a mascara container comprises a conventional bottle 120, having a neck portion 125, and a closure 130 according to the invention. The closure 130 is adapted to co-operate releasably with the neck portion 125 of the container by means, for example, of co-operating screw threads or snap beads (not shown). The closure 130 comprises an extruded aluminium sleeve 131 and a plastics top 132. The top 132 overlaps the sleeve 131 to define a stop 133 against which the aluminium sleeve 131 is pressed during assembly. As previously described in relation to FIGS. 1 and 2, the aluminium sleeve 131 and plastics top 132 are held together using conventional joining techniques.

A plastics insert 134 is provided inside the sleeve 131 and is adapted to provide or hold an applicator, such as a mascara brush 150. The plastics insert 134 may also be modified to define a releasable engagement means, such as a screw thread or snap bead for example, for cooperation with complimentary engagement means on the neck 125 of the container.

Figure 4:
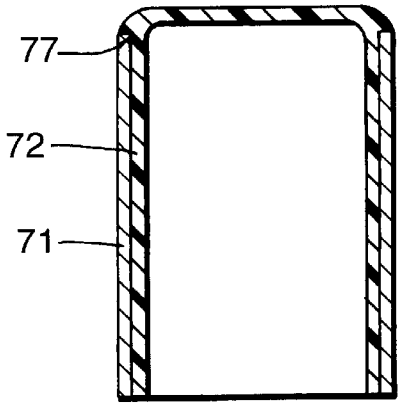
FIGS. 4 to 6 show side section views of three embodiments of part of a container according to the invention.
Figure 5:
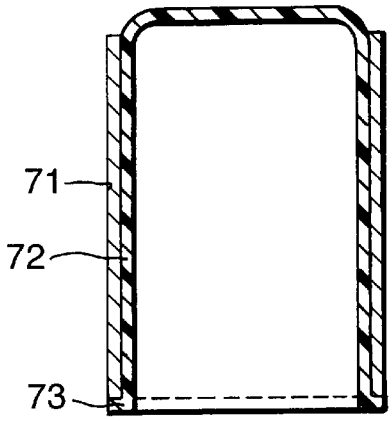
Figure 6:
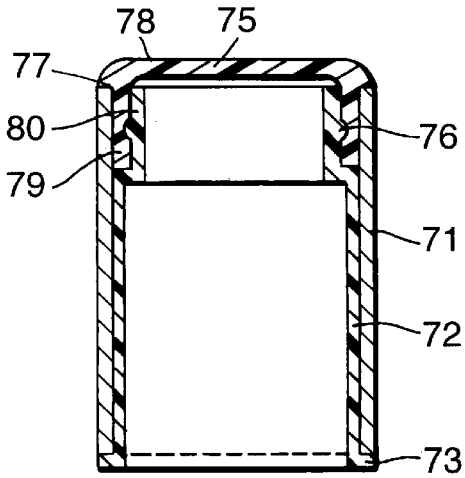

FIGS. 4 to 6 show some examples of the arrangement of plastics and metal parts which are possible in accordance with the invention.

Referring to FIG. 4, an extruded metal sleeve 71 is arranged around a plastics insert 72. The plastics insert 72 provides an end to the metal sleeve 71 and has an overlap, which defines a stop 77 against which the metal sleeve 71 is pressed during assembly. In FIG. 5, the plastics insert 72 again provides an end to the metal sleeve 71. However, in this arrangement, an external rim 73 is provided around the free, open end of the plastics insert 72, to define a stop against which the metal sleeve 71 is pressed during assembly.

The arrangement shown in FIG. 6 comprises a metal sleeve 71, a plastics insert 72 and a separate end cap 75. This arrangement is particularly useful where the end is required to have a metal finish as the separate ends can be easily electroplated. The plastics insert 72 has an external rim 73 around one end, to define a stop against which the metal sleeve 71 is pressed during assembly. The other end of the insert 72 is arranged to define an indent 80 in which the end cap 75 is located. The end cap 75 comprises an end plate 78 and a depending skirt 79. The end plate 78 extends beyond the periphery of the skirt 79 to define a stop 77, which is pressed against the end of the metal sleeve 71 during assembly. The skirt 79 of the end cap 75 is arranged to fit between the external surface of the indent 80 and the adjacent internal surface of the metal sleeve 71. The end cap 75 and indent portion 80 of the insert 72 are provided with mutual snap-engagement portions 76 to retain the end cap 75 in the sleeve 72. The metal sleeve 71 is retained around the plastic parts 72, 75 by the opposed surfaces of the rim 73 and stop 77. Hence no adhesives are required in this arrangement and it is relatively easy to disassemble for the purposes of recycling. When the end cap 75 is prised off the container, the extruded metal sleeve is released and can be removed from the plastics insert 72.

It will be appreciated that the arrangement shown in FIG. 6 may be modified so that the plastics insert 72 extends the entire length of the extruded sleeve 71 (without the indented portion 80). In this arrangement, the end cap 75 fits inside the insert 72 and the stop 77 overlaps the ends of both the insert 72 and sleeve 71 to hold the components together as previously described.

Figure 7A:
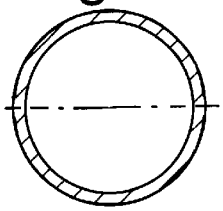
FIGS. 7A to 7L show examples of the possible cross sections which can be manufactured using the method according to the invention.
Figure 7B:
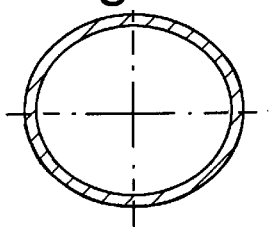
Figure 7C:
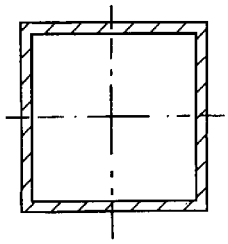
Figure 7D:
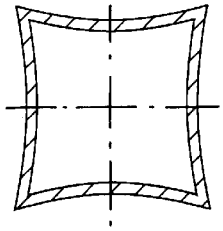
Figure 7E:
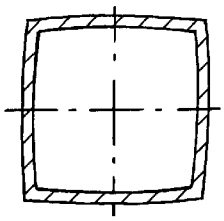
Figure 7F:
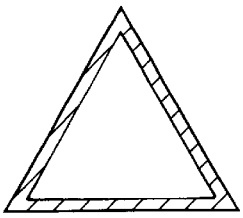
Figure 7G:
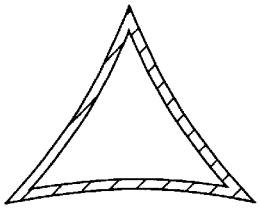
Figure 7H:
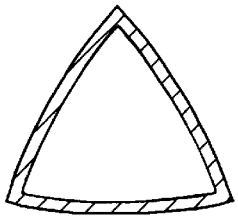
Figure 7I:
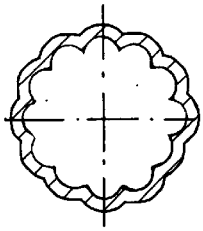
Figure 7J:
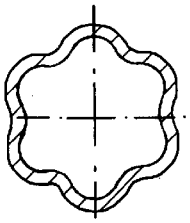
Figure 7K:
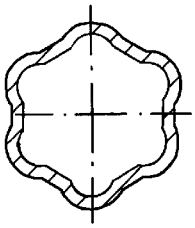
Figure 7L:
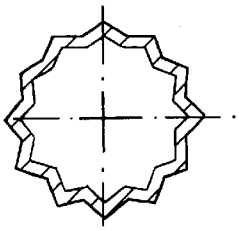

Referring to FIGS. 7A to 7L, the extruded aluminium sleeve may have a wide variety of cross section profiles. These profiles may easily be achieved by using appropriately shaped dies during the extrusion process. The cross sectional profiles include conventional circular and oval sections (as shown in FIGS. 7A and 7B), polygonal sections (as shown in FIGS. 7C and 7F) and more complex profiles such as those shown in FIGS. 7I, 7J, 7K and 7L. Furthermore, such profiles may have concave sides (as shown in FIGS. 7D and 7G) or convex sides (as shown in FIGS. 7E and 7H). The man skilled in the art will be easily appreciate that other cross sectional profiles can be achieved using the extrusion process.

Although a preferred embodiment of the invention has been specifically illustrated and described herein, it is to be understood that minor variations may be made in the apparatus without departing from the spirit and scope of the invention, as defined the appended claims.

What is claimed is:

1. A method of manufacturing a cosmetic container comprising the steps of extruding a metal tube having a length and a predetermined cross-section, cutting the extruded metal tube into a plurality of substantially equal predetermined lengths to produce a plurality of at least one of an extruded outermost top metal sleeve and an extruded outermost bottom metal sleeve of an associated cosmetic container, each of the at least one extruded outermost top metal sleeve and the extruded outermost bottom metal sleeve having a first end and a second end, the first and second metal sleeve ends defining respective first and second openings, providing a synthetic plastic cap defined by an end panel and a peripheral skirt, and fixing the peripheral skirt at least partially interiorly of at least one of the first and second metal sleeve ends of one of the at least one extruded outermost top metal sleeve and the extruded outermost bottom metal sleeve so as to close the opening thereof.

2. The cosmetic container manufacturing method as defined in claim 1 including the step of surface treating an exterior surface of the extruded metal tube prior to the performance of the cutting step.

3. The cosmetic container manufacturing method as defined in claim 2 wherein the providing and fixing steps are performed substantially simultaneously by molding the synthetic plastic cap in situ relative to at least one of the first and second metal sleeve ends.

4. The cosmetic container manufacturing method as defined in claim 1 wherein the providing and fixing steps are performed substantially simultaneously by molding the synthetic plastic cap in situ relative to at least one of the first and second metal sleeve ends.

5. The cosmetic container manufacturing method as defined in claim 1 including the step of electroplating an exterior surface of the extruded metal tube prior to the performance of the cutting step.

6. The cosmetic container manufacturing method as defined in claim 5 wherein the providing and fixing steps are performed substantially simultaneously by molding the synthetic plastic cap in situ relative to at least one of the first and second metal sleeve ends.

7. A method of manufacturing a cosmetic container comprising the steps of extruding a metal tube having a length and a predetermined cross-section, cutting the extruded metal tube into a plurality of substantially equal predetermined lengths to produce a plurality of at least one of an extruded outermost top metal sleeve and an extruded outermost bottom metal sleeve of an associated cosmetic container, each of the at least one extruded outermost top metal sleeve and the extruded outermost bottom metal sleeve having a first end and a second end, the first and second metal sleeve ends defining respective first and second openings, providing a synthetic plastic tubular sleeve including axially opposite first and second tubular end portions, and fixing one of the first and second tubular end portions at least partially interiorly of at least one of the first and second metal sleeve ends of one of the at least one extruded outermost top metal sleeve and the extruded outermost bottom metal sleeve so as to provide a connector for an associated cosmetic container component.

8. The method of manufacturing a cosmetic container as defined in claim 7 wherein the tubular sleeve includes a substantially outwardly directed radial projection, and the fixing step includes seating the radial projection against an axial end surface of one of the at least one first and second metal sleeve ends.

9. The method of manufacturing a cosmetic container as defined in claim 8 including the step of exteriorly telescopically assembling another of the extruded outermost top and bottom metal sleeves relative to another of the first and second tubular end portions.

10. The method of manufacturing a cosmetic container as defined in claim 8 including the step of providing a synthetic plastic cap defined by an end panel and a peripheral skirt, and fixing the peripheral skirt at least partially interiorly of the other of the first and second metal sleeve ends of the at least one extruded top and bottom metal sleeve.

11. The method of manufacturing a cosmetic container as defined in claim 7 including the step of exteriorly telescopically assembling another of the extruded outermost top and bottom metal sleeves relative to another of the first and second tubular end portions.

12. The method of manufacturing a cosmetic container as defined in claim 11 including the step of providing a synthetic plastic cap defined by an end panel and a peripheral skirt, and fixing the peripheral skirt at least partially interiorly of the other of the first and second metal sleeve ends of the at least one extruded top and bottom metal sleeve.

13. The method of manufacturing a cosmetic container as defined in claim 7 including the step of providing a synthetic plastic cap defined by an end panel and a peripheral skirt, and fixing the peripheral skirt at least partially interiorly of the other of the first and second metal sleeve ends of the at least one extruded top and bottom metal sleeve.

14. A method of manufacturing a cosmetic container comprising the steps of extruding a metal tube having a length and a predetermined cross-section, cutting the extruded metal tube into a plurality of substantially equal predetermined lengths to produce at least an extruded outermost top metal sleeve and an extruded outermost bottom metal sleeve of an associated cosmetic container, each of the extruded outermost top and bottom metal sleeves having a first end and a second end, the first and second sleeve ends defining respective first and second openings of the extruded top and bottom metal sleeves, providing first and second synthetic plastic caps each defined by an end panel and a peripheral skirt, providing a synthetic plastic tubular sleeve including axially opposite first and second tubular end portions, locating the peripheral skirt of the first and second plastic caps at least partially interiorly of the top and bottom metal sleeves respective first and second ends so as to close the openings thereof, and locating the plastic tubular sleeve first and second tubular end portions interiorly of the top and bottom metal sleeves respective second and first ends.

15. The cosmetic container manufacturing method as defined in claim 14 including the step of surface treating an exterior surface of the extruded metal tube prior to the performance of the cutting step.

16. The cosmetic container manufacturing method as defined in claim 15 wherein the tubular sleeve includes a substantially outwardly directed radial projection, and the tubular sleeve locating step is performed by seating end surfaces of the metal sleeves against opposite surfaces of the radial projection.

17. The cosmetic container manufacturing method as defined in claim 14 wherein the first and second cap providing and locating steps a re performed substantially simultaneously by molding the synthetic plastic caps each in situ relative to its respective metal sleeve end.

18. The cosmetic container manufacturing method as defined in claim 17 wherein the tubular sleeve includes a substantially outwardly directed radial projection, and the tubular sleeve locating step is performed by seating end surfaces of the metal sleeves against opposite surfaces of the radial projection.

19. The cosmetic container manufacturing method as defined in claim 14 including the step of electroplating an exterior surface of the extruded metal tube prior to the performance of the cutting step.

20. The cosmetic container manufacturing method as defined in claim 14 wherein the tubular sleeve includes a substantially outwardly directed radial projection, and the tubular sleeve locating step is performed by seating end surfaces of the metal sleeves against opposite surfaces of the tubular sleeve radial projection.

* * * * *